US006543771B1

(12) United States Patent
Kirckof

(10) Patent No.: US 6,543,771 B1
(45) Date of Patent: Apr. 8, 2003

(54) BOARD GAME

(76) Inventor: Kurt H. Kirckof, 47992 280th St., Brooten, MN (US) 56316

( * ) Notice: Subject to any disclaimer, the term of this patent is extended or adjusted under 35 U.S.C. 154(b) by 0 days.

(21) Appl. No.: 09/855,215

(22) Filed: May 14, 2001

(51) Int. Cl.[7] ..... A63F 3/00
(52) U.S. Cl. ..... 273/248; 273/258
(58) Field of Search ..... 273/243, 248, 273/258, 139, 138.1

(56) References Cited

U.S. PATENT DOCUMENTS

D157,861 S * 3/1950 Graves ..... D21/351
3,714,722 A * 2/1973 Sonnabend ..... 273/248
3,759,521 A * 9/1973 Breslow et al. ..... 273/120 R
4,194,741 A * 3/1980 Rea ..... 273/241
4,244,579 A * 1/1981 Campos ..... 273/243
5,090,706 A * 2/1992 Hokanson ..... 273/146
5,332,227 A * 7/1994 Passero ..... 273/141 R
5,360,216 A * 11/1994 Counterman ..... 273/243
5,429,371 A * 7/1995 Bledsoe ..... 273/243
5,941,525 A * 8/1999 Gallub ..... 273/248

* cited by examiner

*Primary Examiner*—Benjamin H. Layno
*Assistant Examiner*—V K Mendiratta
(74) *Attorney, Agent, or Firm*—N. Paul Friederichs; Angenehm Law Firm

(57) ABSTRACT

An educational board game includes a game board that has a plurality of spaces marked on a surface of the game board. The spaces include a pair of win spaces, a start space, and a plurality of medial spaces divided between a pair of tracks. Each of the tracks extends between the start space and an associated one of the win spaces. Tokens are provided for moving between adjacent spaces by a player. Movement of tokens on the game board is determined by a combination of chance elements including cards, dice, and spinners for determining direction and number of spaces moved.

14 Claims, 2 Drawing Sheets

BOARD GAME

BACKGROUND OF THE INVENTION

1. Field of the Invention

The present invention relates to board games and more particularly pertains to a new board game for providing users with a educational game that would be fun and challenging for all ages.

2. Description of the Prior Art

The use of board games is known in the prior art. More specifically, board games heretofore devised and utilized are known to consist basically of familiar, expected and obvious structural configurations, notwithstanding the myriad of designs encompassed by the crowded prior art, which have been developed for the fulfillment of countless objectives and requirements.

Known prior art includes U.S. Pat. No. 1,518,306; U.S. Pat. No. 5,092,606; U.S. Pat. No. 3,815,919; U.S. Pat. No. 2,852,260; U.S. Pat. No. Des. 212,889; and U.S. Pat. No. 3,72 1,443.

While these devices fulfill their respective, particular objectives and requirements, the aforementioned patents do not disclose a new board game. The inventive device includes a game board that has a plurality of spaces marked on a surface of the game board. The spaces include a pair of win spaces. The spaces include a start space. The spaces include a plurality of medial spaces such that the medial spaces are divided between a pair of tracks. Each of the tracks is for extending between the start space and an associated one of the win spaces. At least one token is selectively locatable on one of the spaces. The token is adapted to be moved between adjacent spaces by a player. A plurality of cards has instruction indicia on a face of each of the cards. The instruction indicia are for indicating a direction and number of spaces the token is to be moved when the player reads one of the cards. A plurality of spinner assemblies is positioned on the surface of the game board. A first of the spinner assemblies is for indicating a direction of the token to be moved. A second of the spinner assemblies is adapted for indicating a number of cards to be read by the player. A plurality of die each has a plurality of faces. Each of the faces of each of the die has a numerical indicia. The numerical indicia are for indicating a number of spaces to be moved by the token when the player rolls each of the die.

In these respects, the board game according to the present invention substantially departs from the conventional concepts and designs of the prior art, and in so doing provides an apparatus primarily developed for the purpose of providing users with a educational game that would be fun and challenging for all ages.

SUMMARY OF THE INVENTION

In view of the foregoing disadvantages inherent in the known types of board games now present in the prior art, the present invention provides a new board game construction wherein the same can be utilized for providing users with a educational game that would be fun and challenging for all ages.

The general purpose of the present invention, which will be described subsequently in greater detail, is to provide a new board game apparatus and method which has many of the advantages of the board games mentioned heretofore and many novel features that result in a new board game which is not anticipated, rendered obvious, suggested, or even implied by any of the prior art board games, either alone or in any combination thereof.

To attain this, the present invention generally comprises a game board that has a plurality of spaces marked on a surface of the game board. The spaces include a pair of win spaces. The spaces include a start space. The spaces include a plurality of medial spaces such that the medial spaces are divided between a pair of tracks. Each of the tracks is for extending between the start space and an associated one of the win spaces. At least one token is selectively locatable on one of the spaces. The token is adapted to be moved between adjacent spaces by a player. A plurality of cards has instruction indicia on a face of each of the cards. The instruction indicia are for indicating a direction and number of spaces the token is to be moved when the player reads one of the cards. A plurality of spinner assemblies is positioned on the surface of the game board. A first of the spinner assemblies is for indicating a direction of the token to be moved. A second of the spinner assemblies is adapted for indicating a number of cards to be read by the player. A plurality of die each has a plurality of faces. Each of the faces of each of the die has a numerical indicia. The numerical indicia are for indicating a number of spaces to be moved by the token when the player rolls each of the die.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new board game apparatus and method which has many of the advantages of the board games mentioned heretofore and many novel features that result in a new board game which is not anticipated, rendered obvious, suggested, or even implied by any of the prior art board games, either alone or in any combination thereof.

It is another object of the present invention to provide a new board game which may be easily and efficiently manufactured and marketed.

It is a further object of the present invention to provide a new board game which is of a durable and reliable construction.

An even further object of the present invention is to provide a new board game which is susceptible of a low cost of manufacture with regard to both materials and labor, and which accordingly is then susceptible of low prices of sale to the consuming public, thereby making such board game economically available to the buying public.

Still yet another object of the present invention is to provide a new board game which provides in the apparatuses and methods of the prior art some of the advantages thereof, while simultaneously overcoming some of the disadvantages normally associated therewith.

Still another object of the present invention is to provide a new board game for providing users with a educational game that would be fun and challenging for all ages.

Yet another object of the present invention is to provide a new board game which includes a game board that has a plurality of spaces marked on a surface of the game board. The spaces include a pair of win spaces. The spaces include a start space. The spaces include a plurality of medial spaces such that the medial spaces are divided between a pair of tracks. Each of the tracks is for extending between the start space and an associated one of the win spaces. At least one token is selectively locatable on one of the spaces. The token is adapted to be moved between adjacent spaces by a player. A plurality of cards has instruction indicia on a face of each of the cards. The instruction indicia are for indicating a direction and number of spaces the token is to be moved when the player reads one of the cards. A plurality of spinner assemblies is positioned on the surface of the game board. A first of the spinner assemblies is for indicating a direction of the token to be moved. A second of the spinner assemblies is adapted for indicating a number of cards to be read by the player. A plurality of die each has a plurality of faces. Each of the faces of each of the die has a numerical indicia. The numerical indicia are for indicating a number of spaces to be moved by the token when the player rolls each of the die.

Still yet another object of the present invention is to provide a new board game that provides users with a versatile game the cold allow preschool and early school players to enjoy hours of fun and learning. In addition to being used in the home, a game such as this could also have appeal to schools that provide educational toys for children. Older children and adults could enjoy the game.

Even still another object of the present invention is to provide a new board game that would allow users to identify numbers and through moving their tokens give players a sense of accomplishment and provide an educational, yet entertaining pastime. The players would enjoy the process and would therefore better retain the facts learned.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
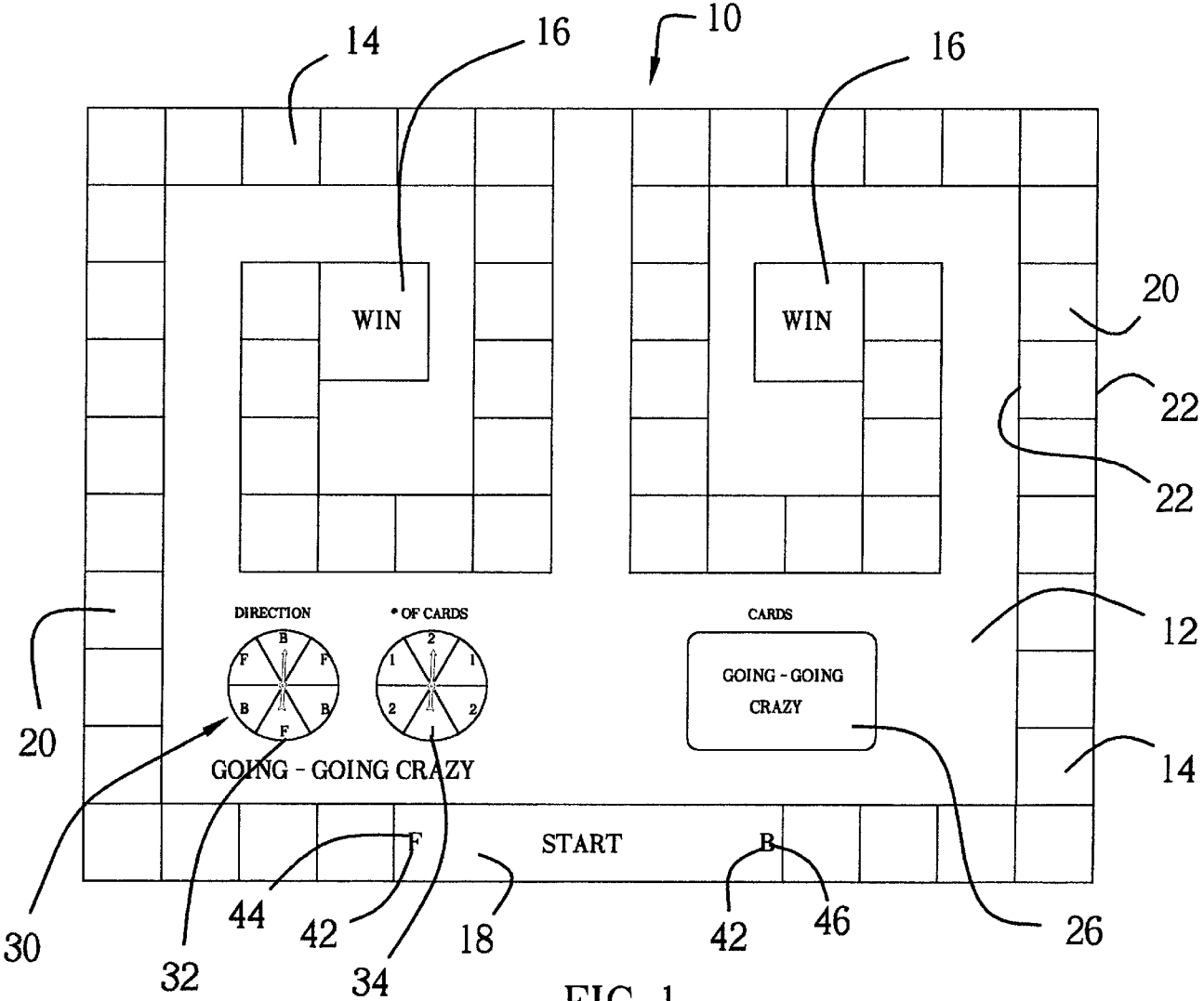
FIG. 1 is a top view of a new board game according to the present invention.
Figure 2:
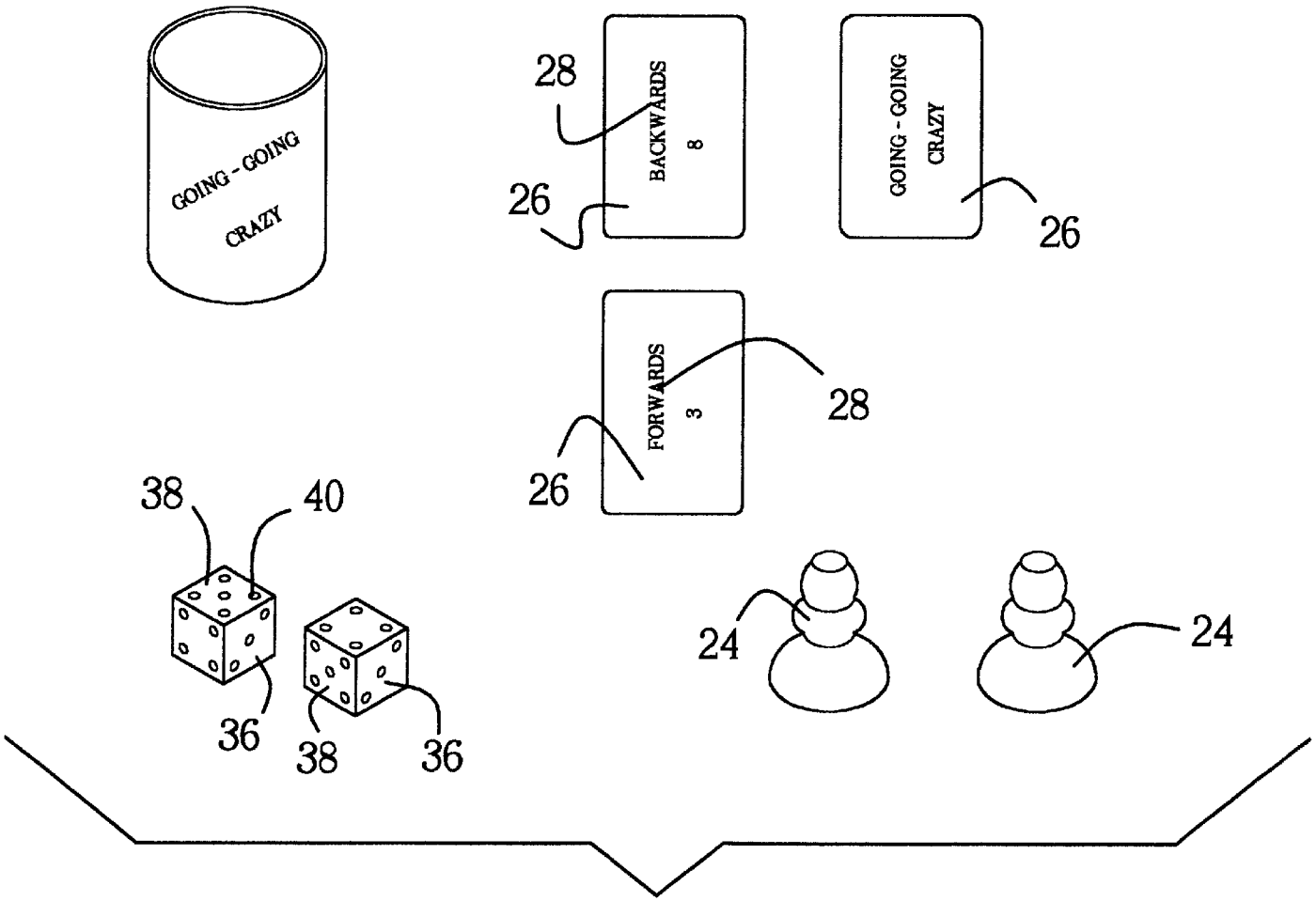
FIG. 2 is a perspective view of the present invention.

With reference now to the drawings, and in particular to FIGS. 1 through 2 thereof, a new board game embodying the principles and concepts of the present invention and generally designated by the reference numeral 10 will be described.

As best illustrated in FIGS. 1 through 2, the board game 10 generally includes a game board 12 that has a plurality of spaces 14 marked on a surface of the game board 12. The spaces 14 include a pair of win spaces 16. The spaces include a start space 18. The spaces 14 include a plurality of medial spaces 20 such that the medial spaces 20 are divided between a pair of tracks 22. Each of the tracks 22 is for extending between the start space 18 and an associated one of the win spaces 16. At least one token 24 is selectively locatable on one of the spaces 14. The token 24 is adapted to be moved between adjacent spaces 14 by a player. A plurality of cards 26 has instruction indicia 28 on a face of each of the cards 26. The instruction indicia 28 are for indicating a direction and number of spaces the token 24 is to be moved when one of the cards 26 is read by the player. A plurality of spinner assemblies 30 is positioned on the surface of the game board 12. A first of the spinner assemblies 32 is for indicating a direction of the token 24 to be moved. A second of the spinner assemblies 34 is adapted for indicating a number of cards 26 to be read by the player. A plurality of die 36 each has a plurality of faces 38. Each of the faces 38 of each of the die 36 has a numerical indicia 40. The numerical indicia 40 are for indicating a number of spaces 14 to be moved by the token 24 when the player rolls each of the die 36.

The start space 18 has a plurality of direction indicia 42. One of the direction indicia 42 is positioned proximate one of the tracks 22. Each of the direction indicia 42 is for indicating the direction of movement represented by each of the associated one of the tracks 22.

The plurality of direction indicia 42 includes a first direction indicia 44 and a second direction indicia 46. The first direction indicia 44 are for indicating the associated one of the tracks 22 being for forward movement of one of the tokens 24. The second direction indicia 46 are for indicating the associated one of the tracks 22 being for backward movement of one of the tokens 24.

In use, each player chooses one of the tokens for indicating the position of a player on the game board. Each player places a respective one of the tokens on the starting space of the game board. Each of the players utilizes the movement means in turn for determining direction and number of spaces for one of the tokens to be moved. The respective one of the tokens is moved the direction and number of spaces indicated by the movement means. A winner is determined when one of the players moves the respective token into one of the winning spaces.

The movement means includes a direction spinner for determining a direction one of the tokens to be moved. The movement means includes a plurality of die for determining the number of spaces one of the tokens to be moved. Wherein actuating of the direction spinner by one of the players in turn indicates the direction the respective one of the tokens is to be moved. Wherein rolling of the plurality of die by the respective player indicates a number of spaces the respective one of the tokens is to be moved in the direction indicated by the direction spinner.

Each of the die has a plurality of faces. Each of the faces of one of the die has a unique numerical indicia. The indicia are for indicating the number of spaces to be moved by one of the tokens. Wherein a user moves the respective one of the tokens the number of spaces equal to the numerical indicia on one of the faces of one of the die when the plurality of the die are rolled and the numeric indicia of an upwardly one of the faces of each of the die are equal.

In an embodiment the method of playing a game further includes a movement means that includes a plurality of cards. A face of each of the cards has instruction indicia. The instruction indicia is for indicating the direction and number of space one of the tokens is to be moved, wherein taking of at least one of the cards by one of the players in turn and moving the respective one of the tokens the direction and number of spaces indicated by the instruction indicia on one of the cards.

The movement means includes a selection spinner for determining a number of cards to by selected by one of the players in turn. One of the players actuates the selection spinner which in turn indicates a number of cards to be selected the respective one of the players such that the respective one of the players moves the respective one of the tokens the direction and number spaces indicated by each of the cards selected by the respective one of the players.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a game comprising:

providing a game board comprising:

a plurality of spaces marked on a surface of said game board, said spaces including a start space, a pair of win spaces, and a plurality of medial spaces, said medial spaces being divided between a pair of tracks, each of said tracks extending between said start space and an associated one of said win spaces; and at least one token being selectively locatable on and moveable between said spaces;

starting each token on said starting space;

taking turns moving each token until a winner is determined, each turn including randomly determining which win space to move said token toward, randomly determining a number of spaces to move said token and moving said token; and determining a winner when one token is moved onto one of said win spaces.

2. The method of playing a game as set forth in claim 1, wherein the step of taking turns further comprises the steps of:

using a direction spinner for randomly determining the direction to move; and rolling at least one die for determining the number of spaces to move.

3. The method of playing a game as set forth in claim 2, wherein each of said die have a plurality of faces, each of said faces of said die having a unique numerical indicium, and said indicium indicating the number of spaces to be moved by one of said tokens.

4. The method of playing a game as set forth in claim 1, wherein the step of taking turns further comprises the steps of:

using a plurality of cards, a face of each of said cards having instruction indicia, said instruction indicia indicating the direction and number of spaces one of said tokens is to be moved.

5. The method of playing a game as set forth in claim 4, wherein the step of taking turns further comprises the steps of:

operating a selection spinner for determining a number of cards to by selected by one of the players in one turn.

6. A game comprising:

a game board having a plurality of spaces marked on a surface of said game board, said spaces including a start space, a pair of win spaces, and a plurality of medial spaces with said medial spaces being divided between a pair of tracks, each of said tracks extending between said start space and an associated one of said win spaces;

at least one token being selectively locatable and movable between said spaces;

at least one randomizer randomly indicating a direction and randomly indicating a number of spaces said token is to be moved, said each of at least one randomizer being adapted for use at each turn and wherein the at least one randomizer further includes at least one spinner assembly indicating a number of cards to be read by the player.

7. The game as set forth in claim 6, wherein each start space further comprises:

a plurality of direction indicia indicating a direction of movement.

8. The game as set forth in claim 7, wherein said plurality of direction indicia further comprises:

a first direction indicium and a second direction indicium, said first direction indicium indicating the associated one of said tracks is for initial forward movement, said second direction indicium indicating the associated one of said tracks is for initial backward movement of one of said tokens.

9. The game of claim 6 wherein the at least one randomizer further comprises:

a plurality of cards having instruction indicia on a face of each of said cards.

10. The game of claim 6 wherein the at least one spinner assembly further indicates a direction said token is to be moved.

11. The game of claim 10 wherein the at least one spinner assembly is two spinner assemblies.

12. The game of claim 6 wherein the at least one randomizer further comprises:

a plurality of die each having a plurality of faces, each of said faces of each of said die having a numerical indicium, said numerical indicium being for indicating a number of spaces to be moved by said token.

13. The game of claim 12 wherein at least one of the plurality of die further indicates a direction of said token to be moved.

14. A method of playing a game comprising:

providing a plurality of spaces in a track, said spaces including a pair of win spaces at either end of said track, medial spaces between said win spaces, and a central medial start space;

providing at least one token being selectively locatable on and moveable between said spaces;

starting each token on said start space;

taking turns moving each token until a winner is determined, each turn including randomly determining which win space to move said token toward, randomly determining a number of spaces to move said token and moving said token; and determining a winner when one token is moved onto one of said win spaces.

* * * * *